US005205223A

United States Patent [19]

Ball et al.

[11] Patent Number: 5,205,223

[45] Date of Patent: Apr. 27, 1993

[54] FOLDING TABLE

[75] Inventors: Douglas C. Ball, Senneville, Canada; Donald R. Ritter, Grapevine; Johnny C. Fraga, Ft. Worth, both of Tex.

[73] Assignee: Steelcase Inc., Grand Rapids, Mich.

[21] Appl. No.: 689,704

[22] Filed: Apr. 18, 1991

[51] Int. Cl.[5] ..... A47B 3/00

[52] U.S. Cl. ..... 108/124; 108/157; 108/115

[58] Field of Search ..... 108/124, 123, 115, 128, 108/157, 150, 131, 132; 248/188.6, 188.7, 188.1

[56] References Cited

U.S. PATENT DOCUMENTS

| | | | |
|---|---|---|---|
| Re. 30,020 | 6/1979 | Spencer et al. . | |
| D. 164,295 | 8/1951 | Gierlich . | |
| 628,712 | 7/1899 | Hoshour . | |
| 1,793,709 | 2/1931 | Meyers | 108/157 |
| 1,800,685 | 4/1931 | Griffis | 108/157 |
| 1,939,459 | 12/1933 | Murray . | |
| 1,939,904 | 12/1933 | Koopman . | |
| 2,073,156 | 2/1937 | Botnick | 108/115 X |
| 2,791,477 | 5/1957 | Wesbecher | 108/124 |
| 3,124,085 | 3/1964 | Sanchez . | |
| 3,166,029 | 1/1965 | Acton | 108/124 |
| 3,525,492 | 5/1969 | Friedman et al. . | |
| 4,178,858 | 12/1979 | Ponzellini | 250/188.7 X |
| 4,196,675 | 4/1980 | Cook | 108/124 K |
| 4,406,437 | 9/1983 | Wright | 248/188.7 X |

FOREIGN PATENT DOCUMENTS

| | | | |
|---|---|---|---|
| 65233 | 11/1892 | Fed. Rep. of Germany | 108/115 |
| 628080 | 8/1949 | United Kingdom | 108/115 |

OTHER PUBLICATIONS

"Folding Tables:—Design by Hugh Acton" (5 pages). believed to be published in the 1970's.

"Lune D'Argent Series" (2 pages). Original publication date not definitely known, but precedes this application by more than one year.

*Primary Examiner*—Jose V. Chen

*Attorney, Agent, or Firm*—Leydig, Voit & Mayer

[57] ABSTRACT

A folding table which comprises a table top; two pedestal members; an elongated cross brace member rotatably connected to both of the pedestal members; and hinge assemblies for pivotably connecting the table top to the pedestal members, each of which comprises a radially extending arm section and a leg section which are rotatable a substantial angle with respect to the cross brace member to support the table top in a horizontal position and maintain the folding table in an upright and unfolded conformation.

20 Claims, 5 Drawing Sheets

FOLDING TABLE

FIELD OF THE INVENTION

This invention relates to foldable tables. More particularly, the invention relates to a table having a solid top and a base which is rigidly secured to the top when the table is in the unfolded conformation, but which base is also rotatable and pivotable with respect to the top to allow the table to be folded into a compact configuration.

BACKGROUND OF THE INVENTION

While a wide variety of folding tables are known in the art, heretofore tables which are uncomplicated and simple to manufacture yet sturdy enough for commercial and heavy duty applications have not been invented or disclosed. Generally, folding tables comprising few operable parts which are also simple to manufacture and operate are suitable only for lightweight applications. These tables are most often used to serve meals in hospitals and households and are commonly referred to as hospital trays or "TV" trays. Sturdier folding tables designed for larger applications, for example, conference tables, are generally comprised of numerous linked support members and are therefore difficult to manufacture, heavier than their less sturdy counterparts, and arduous to maneuver from an unfolded to a folded conformation. Moreover, the linked support members make the tables aesthetically unpleasing and therefore unsuitable for applications in which aesthetics is a consideration.

SUMMARY OF THE INVENTION

Therefore, it is an object of the present invention to provide a folding table which is comprised of few parts and is therefore simple to manufacture and operate, yet is sufficiently sturdy to allow the table to be used in heavy duty applications, for example, as a conference table.

According to the present invention, these and other objects and advantages are achieved by providing a folding table having, in one of its more specific embodiments, a solid table top, two pedestal members which are both rotatably and pivotably connected to the table top, and a cross brace member extending between and supporting the pedestal members to thereby create a strong, sturdy support for the table top. Each pedestal member comprises an arm section for supporting the table top in a horizontal position and a leg section for maintaining the table in an upright position when the table is in the unfolded conformation. Each arm section is comprised of a cylindrical hub having a uniform inner diameter, a stepped outer diameter and at least one extending arm, while each leg section is comprised of a similarly conformed cylindrical hub and at least one extending leg. Each pedestal member also comprises an outer cylindrical tube which rotatably connects an end of the cross brace member to a respective pedestal member. The adjacent smaller diameter sections of the arm and leg hubs are received within the respective tube members and interlock to prevent relative rotation of the arm and leg sections. Each pedestal member further comprises an inner cylindrical member rotably received within the arm and leg hubs. Each inner cylindrical member extends from the bottom of the corresponding leg hub past the top of the arm hub and is secured to either the top of the arm hub or to the underside of the table top via a pivot means, which allows the table top to pivot about an axis parallel to the cross brace member. Thus, the arm and leg sections are rotatable relative to both the cross brace member and the inner cylindrical member, while the table top is pivotable about the top of both pedestal members.

The table of the present invention is "folded" by rotating each arm and, therefore, due to the interlocking portions of the arm and leg hubs, each leg, from a position perpendicular to the cross brace member to a position parallel to the cross brace member. In this position the table top can pivot about the pedestal members from a horizontal to a vertical position. The folded table provides a thin, compact profile which allows the table to be easily moved and conveniently stored. To unfold the table, the top is pivoted about the pedestal members to a position perpendicular to the pedestal members and the arms and legs are rotated to a position perpendicular to the cross brace member. When the arms are so positioned, the table top is prevented from pivoting about the pedestals.

Thus, a folding table which is comprised of few parts and is therefore simple and cost effective to manufacture, yet is sturdy in the unfolded position and therefore capable of functioning in heavy duty applications, is achieved by the present invention. The present folding table is also easy to manipulate from a folded to an unfolded conformation, and vice versa. Moreover, the folding table comprises a relatively clean and efficient design which is pleasing to the eye.

These and other objects and advantages of the present invention will be made apparent from the following detailed description, with reference to the accompanying drawings.

DETAILED DESCRIPTION OF THE PREFERRED EMBODIMENTS

Figure 1:
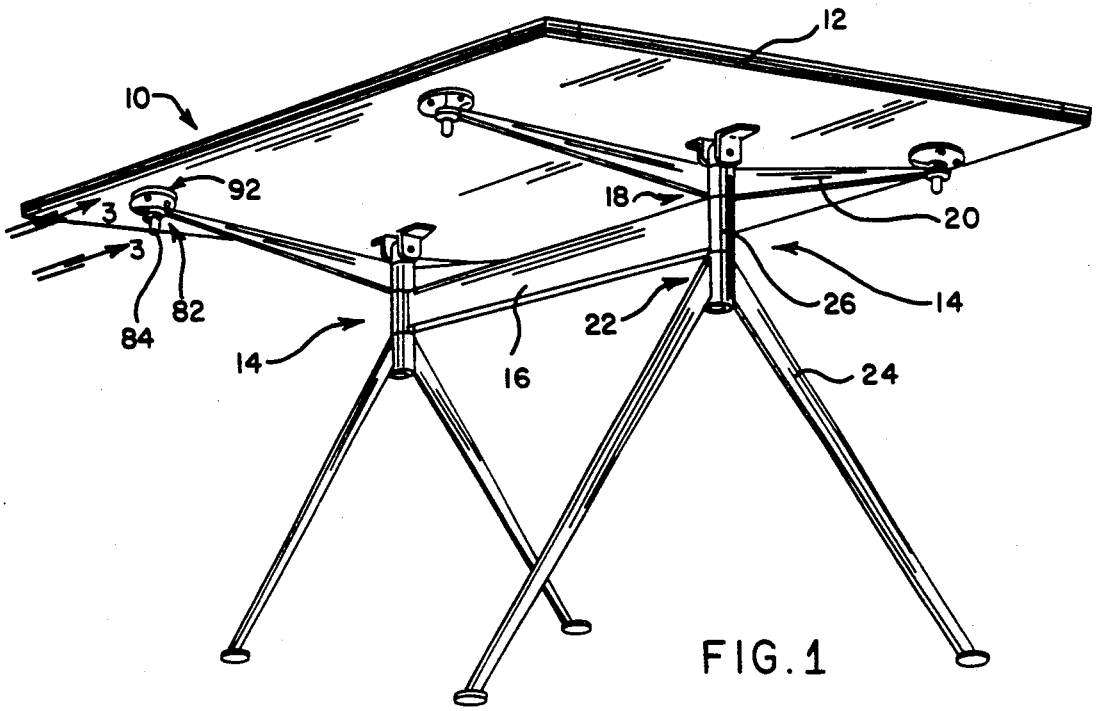
FIG. 1 is a perspective view of the folding table of the present invention showing the table in the unfolded conformation.

Referring to FIG. 1, one embodiment of the folding table according to the present invention is indicated generally by reference numeral 10. Folding table 10 comprises a solid table top 12, two pedestal members, each indicated generally by reference numeral 14, and a cross brace member 16, which extends between and is connected to pedestal members 14. Each pedestal member 14 comprises an arm section 18 having at least one radially extending arm 20, a leg section 22 having at least one, but in the embodiment depicted in FIG. 1, two downwardly extending legs 24, and an outer cylindrical tube member 26 positioned between arms 20 and legs 24 and around the adjacent portions of arm section 18 and leg section 22, as will be described more fully with reference to FIG. 2. When table 10 is unfolded for use, as in FIG. 1, arm sections 18 and leg sections 22 are at a substantial angle to cross brace member 16, preferably approximately ninety degrees. In this conformation, arm sections 18 support table top 12 in a horizontal position generally perpendicular to pedestal members 14, and leg sections 22 maintain table 10 in an upright position.

Figure 2:
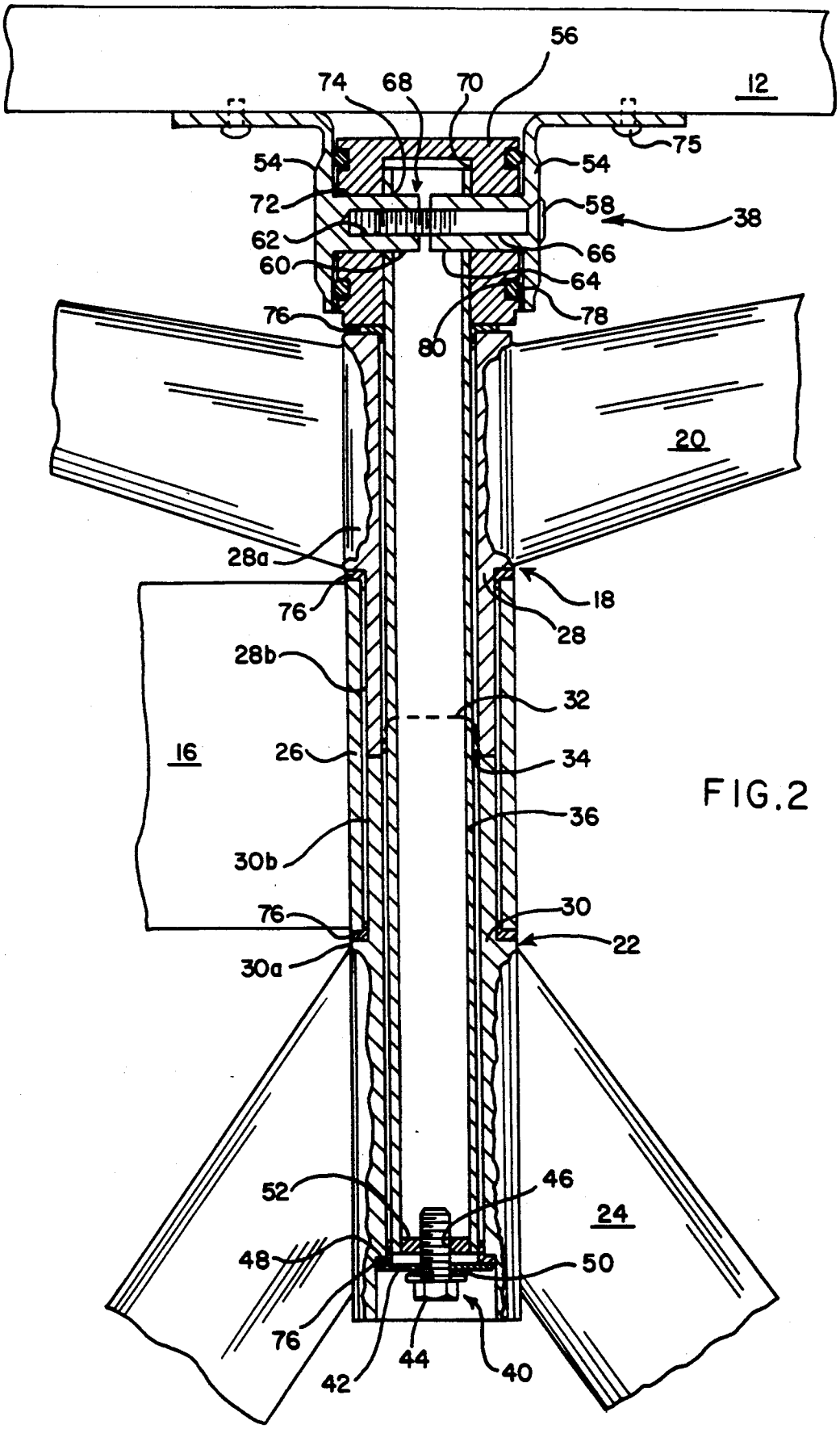
FIG. 2 is a partial cross-sectional view of a portion of the pedestal member and pivot means of the embodiment of the table depicted in FIG. 1.

Referring to FIG. 2, in the embodiment of the table depicted in FIG. 1 each arm section 18 further comprises a cylindrical arm hub 28 having a uniform inner diameter and a stepped outer diameter. Similarly, each leg section 22 comprises a cylindrical leg hub 30 having a uniform inner diameter and a stepped outer diameter corresponding to the inner diameter and stepped outer diameter of arm hub 28. The adjacent ends of each arm hub 28 and each leg hub 30 have keyed end portions 32 and 34, respectively, which allow arm section 18 and leg section 22 to interlock to prevent relative rotation therebetween when pedestal 14 is assembled. Each end of cross brace member 16 is connected, as by welding or any suitable means, to cylindrical tube member 26, which has an outer diameter corresponding to the larger outer diameter portions 28*a* and 30*a* of arm and leg hubs 28 and 30, respectively, and an inner diameter corresponding generally to the smaller outer diameter portions 28*b* and 30*b* of arm and leg hubs 28 and 30, respectively. The smaller outer diameter portions 28*b* and 30*b* are rotatably received within tube member 26 when each pedestal member 14 is assembled, the inner diameter of cylindrical tube 26 being slightly greater than the smaller outer diameter portions 28*b* and 30*b* to permit rotation of arm hub 28 and leg hub 30 within tube 26, and, thus, relative rotation of arm section 18 and leg section 22 with respect to cross brace member 16.

Referring still to FIG. 2, each pedestal member 14 further comprises an inner cylindrical member 36 extending axially through arm and leg hubs 28 and 30. Cylindrical member 36 has an outer diameter slightly smaller than the inner diameters of arm and leg hubs 28 and 30 to permit relative rotation of arm and leg hubs 28 and 30 about cylindrical member 36. The top portion of cylindrical member 36 extending above arm hub 28 is attached to a pivot means 38, which pivotably connects cylindrical member 36 and, therefore, pedestal member 14, to the underside of table top 12 approximately along a centerline thereof. Securing means 40 is employed to rotatably connect the bottom of leg hub 30, and thus leg section 22, to the bottom of cylindrical member 36. Securing means 40 comprises a washer 42 and a screw 44, which extends through washer 42 and into a threaded hole 46 in the end of inner cylindrical member 36. Washer 42 in turn engages an annular shoulder 48 formed by an enlargement of the inner diameter of leg hub 30 near the bottom thereof to thereby support leg section 22, tube member 26, and arm section 18 on cylindrical member 36 when each pedestal member 14 is assembled. A second washer 50 may be employed between washer 42 and the head of screw 44. Preferably, washer 50 is a friction reducing washer, such as a nylon washer, to facilitate rotation of washer 42 relative to screw 44. Cylindrical member 36 is preferably hollow to help maintain the weight of table 10 at a minimum. In such a construction the diameter of screw 44 may correspond to the inner diameter of cylindrical member 36 to allow screw 44 to be threaded directly therein, or, as shown in FIG. 2, the bottom of cylindrical member 36 can be sealed by a plug member 52 through which hole 46 is formed.

An embodiment of the pivot means 38 preferably employed for use with the embodiment of the table shown in FIG. 1 will be described by reference to FIG. 2. Each pivot means 38 comprises a pair of generally L-shaped pivot brackets 54, a pivot member 56 positioned between pivot brackets 54, and a screw 58 for pivotably connecting pivot member 56 to pivot brackets 54, as will be described. The left pivot bracket 54, as viewed in FIG. 2, comprises a transverse cylindrical pintle member 60 having an internally threaded bore 62 extending partially therethrough, while the right pivot bracket 54 comprises a similar transverse cylindrical pintle member 64 having a bore 66 extending completely therethrough. Screw 58 extends through bore 66 and engages threaded bore 62 to conjoin pintle members 60 and 64 and thereby create a pintle 68 when pivot means 38 is assembled. Pivot member 56 is provided with a vertical bore 70, into which the top of inner cylindrical member 36 is received, and a horizontal bore 72 extending completely therethrough. Pintle 68 extends through bore 72 and a corresponding bore 74 in cylindrical member 36 to connect cylindrical member 36 and, thus, pedestal member 14 to pivot means 38. In this arrangement, pedestal 14, in conjunction with pivot member 56, is free to rotate or pivot about pintle 68. The bottom of pivot member 56 engages the top of arm hub 28 when arm section 18, tube member 26, and leg section 22 are supported on inner cylindrical member 36 by securing means 40. Thus, arm hub 28, tube member 26 and leg hub 30 are held or "sandwiched" between securing means 40 and pivot member 56 to prevent longitudinal movement of arm and leg sections 18 and 22 and tube member 26 with respect to inner cylindrical member 36. Pivot brackets 54 are connected to the underside of table top 12 by screws 75, or any appropriate means, to firmly secure pivot means 38 and pedestals 14 to table top 12, while permitting pivotable movement of pedestals 14 with respect to table top 12.

Preferably, friction reducing means, such as nylon washers or grommets 76, are employed between pivot member 56 and arm hub 28, arm hub 28 and tube member 26, tube member 26 and leg hub 30, and leg hub 30 and securing means 40 to facilitate rotation of arm and leg sections 18 and 22 with respect to pivot member 56, tube member 26 and securing means 40. In addition, these same grommets 76 may be formed to extend slightly between tube member 26 and the smaller outer diameter portions 28*b* and 30*b* of arm and leg hubs 28 and 30, and between arm and leg hubs 28 and 30 and inner cylindrical member 36 to facilitate the relative rotation of these elements.

Each pivot means 38 also preferably comprises dampening means 78, which can be, for example, an elastomeric "O"-type ring as depicted in FIG. 2, friction inducing washers or discs, or any suitable means. Each dampening means or ring 78 is positioned in a corresponding annular groove 80 formed in each end of pivot member 56 adjacent the downward extending portions of brackets 54. Tightening of screw 58 during assembly of pivot means 38 causes rings 78 to deform into the spaces between each end of pivot member 56 and brackets 54. In this condition, rings 78 increase the frictional force required to be overcome in order to pivot or rotate pedestals 14 and pivot member 56 with respect to pintle 68 and therefore aid in reducing the angular momentum of table top 12 when table 10 is being folded or unfolded, thereby permitting the operator to more easily control the folding and unfolding operations.

From the foregoing description it should be understood that each pedestal member 14 is comprised of a triple column construction. The outer column is formed by the larger outer diameter portion 28*a* of arm hub 28, cylindrical tube 26, and the larger outer diameter portion 30*a* of leg hub 30, the ends of which abut and are held together when pedestal 14 is assembled and connected to pivot means 38. The middle column is defined by the smaller outer diameter portions 28*b* and 30*b* of arm and leg hubs 28 and 30, which interlock at sections 32 and 34 when pedestal member 14 is assembled to prevent relative rotation of arm section 18 with respect to leg section 22. The inner column is the inner cylindrical member 36, which extends through leg hub 30 and arm hub 28. Inner cylindrical member 36 is rotatably connected to the bottom of leg hub 30 by securing mean 40 and pivotably connected to the underside of table top 12 by pivot means 38. Thus, arm section 18 and leg section 22 are rotatable with respect to both inner cylindrical member 36 and cylindrical tube member 26. That is, the smaller outer diameter portions 28*b* and 30*b* of arm and leg hubs 28 and 30, which define part of the middle column, are appropriately sized to rotate within tube member 26, which forms part of the outer column, while the entire arm and leg hubs 28 and 30, including the larger outer diameter portions 28*a* and 30*a* forming the remainder of the outer column, are designed to rotate about inner cylindrical member 36, which defines the inner column. Tube member 26 is prevented from rotating relative to inner cylindrical member 36 due to the fact that both tube members 26 are fixed to the ends of cross brace member 16. The axes of both pivot means 38 are aligned with cross brace member 16 to restrict the pivotable movement of pedestals 14 to a direction perpendicular to the plane defined by cross brace member 16 and both pivot means 38. Thus, when arms 20 are perpendicular to cross brace member 16, table top 12 is prevented from pivoting about pivot means 38 and is thereby supported in the horizontal position. Furthermore, since cross brace member 16 is connected to both pedestals 14, pedestals 14 are allowed to pivot simultaneously. Cross brace member 16 thus connects both pedestals 14 to effectively create a single, sturdy table support when the table is in either the folded or unfolded conformation.

Figure 3:
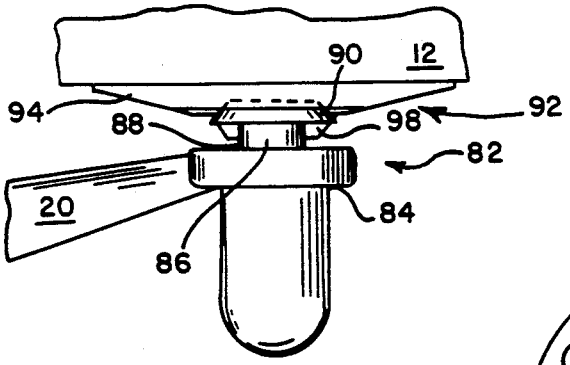
FIG. 3 is a side elevational view of a portion of the folding table taken along line 3—3 of FIG. 1.
Figure 4:
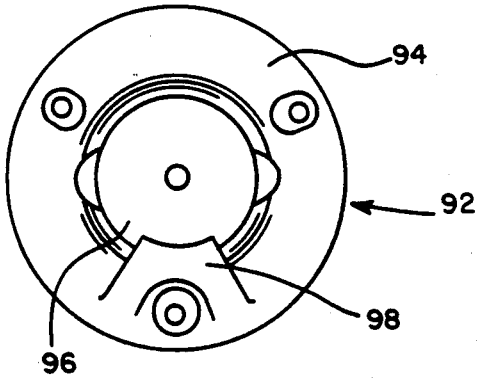
FIG. 4 is a bottom view of the coupling means element of the embodiment of the table depicted in FIG. 1.

Referring now to FIG. 3, table 10 further comprises handle means 82 appended to the end of each arm 20. Each handle means 82 comprises a handle member 84, which is either formed as part of arm 20 in a single casting operation or attached thereto by suitable means, and an upwardly extending peg 86 having a stem 88 and an enlarged frustoconical head 90. The top of head 90 is preferably spaced a short distance, for example one-quarter inch, from the underside of table top 12 to prevent head 90 from impeding on the underside of top 12 during rotation of arms 20. Each head 90 may be connected to its corresponding stem 88 by means of a swivel (not shown) to facilitate engagement of handle means 82 with a corresponding coupling means, as will be described. Referring to FIGS. 3 and 4, table 10 is also provided with coupling means 92 located proximate each handle means 82 when arms 20 are at a predetermined substantial angle, preferably ninety degrees, relative to cross brace member 16. Each coupling means 92 is attached to the underside of table top 12 by screws or any suitable means (not shown) and comprises a generally circular, convex base 94 having a central annular depression 96, and an upstanding tab 98 located at the edge of depression 96. Handle means 82 on the ends of arms 20 are secured to table top 12 when heads 90 of pegs 86 engage the convex surface of bases 94 and are thereby guided into depressions 96. Tabs 98 prevent pegs 86 from overshooting depressions 96 and thereby ensure a secure engagement of handle means 82 to coupling means 92.

Figure 5:
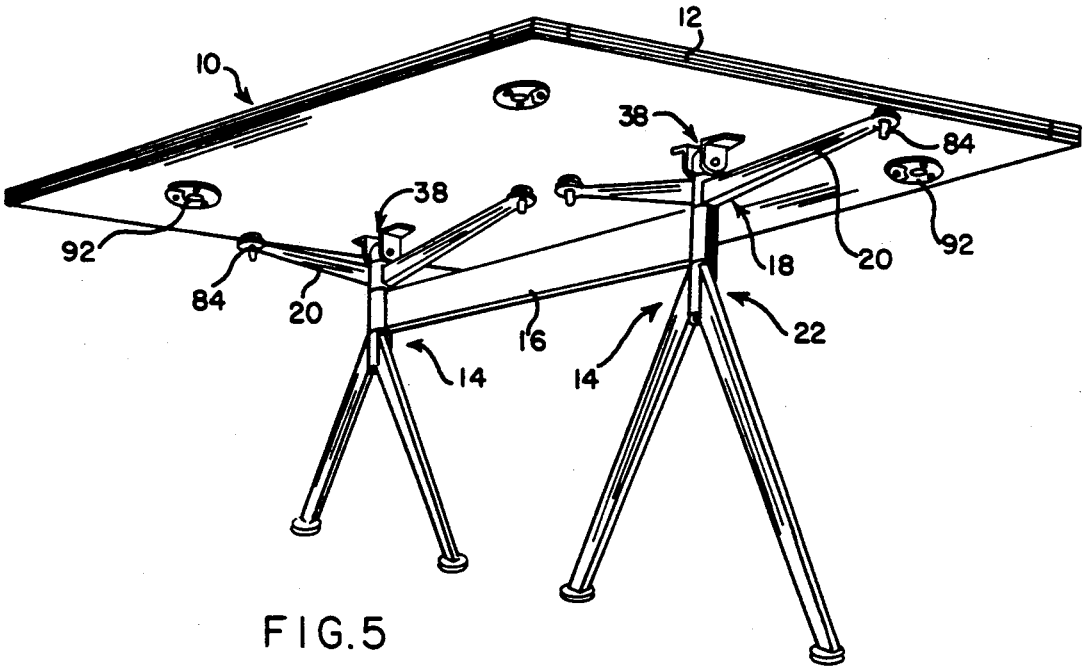
FIG. 5 is a perspective view of the table of FIG. 1 in the partially folded conformation.
Figure 6:
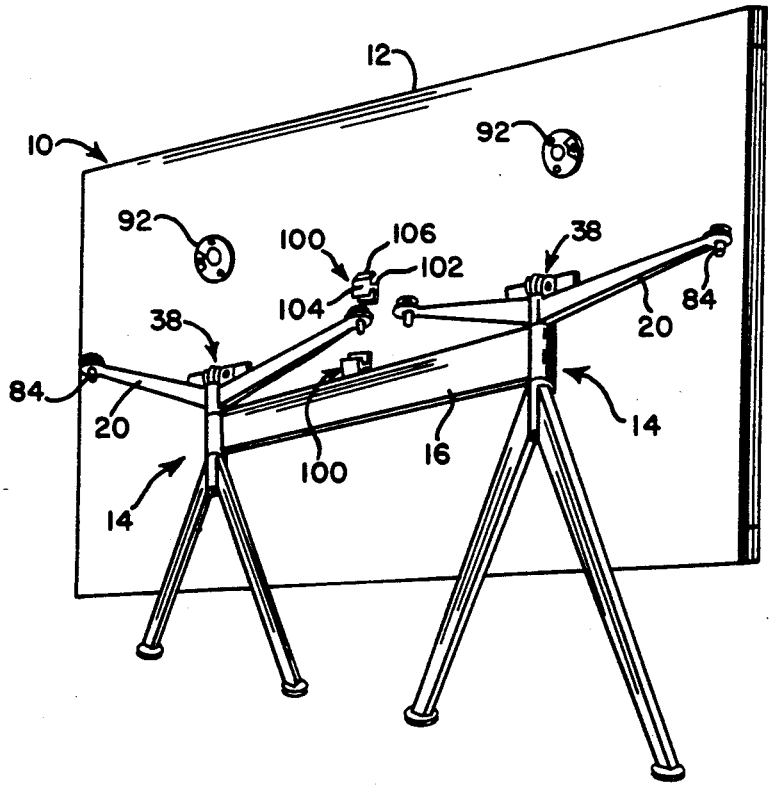
FIG. 6 is a perspective view of the table of FIG. 1 in the folded conformation.

Operation of the present invention will be described by reference to FIGS. 1, 5 and 6. Beginning with the table in the unfolded conformation (FIG. 1), arm section 18 and leg section 22 of each pedestal member 14 are aligned with cross brace member 16 by grasping an appropriate handle 84 and rotating the corresponding arms 20 a substantial angle, in this example approximately ninety degrees, toward the center of table top 12. In this position (FIG. 5), table top 12 is free to pivot about pivot means 38 and is folded approximately ninety degrees into alignment with pedestal members 14 (FIG. 6). Of course, table top 12 may be placed on its side or upside down on the floor prior to folding, in which instances pedestal members 14 would be pivoted into alignment with top 12 to attain the folded conformation. It is readily apparent by reference to FIG. 6 that, in the folded conformation, table 10 projects a compact, thin profile that facilitates moving or storing table 10 when not in use. Moreover, dampening means 78, previously described, will help prevent rotational movement of table top 12 relative to pedestal members 14 when table 10 is being transported in its folded conformation. To unfold table 10, top 12 is pivoted approximately ninety degrees relative to pedestal members 14, the arms 20 of which are then rotated a substantial angle relative to cross brace member 16 until heads 90 of handle means 82 engage coupling means 92 to secure arms 20 to the underside of table top 12. Thus, the folding or unfolding operation can be performed in three steps: rotating a first pedestal member 14, rotating the second pedestal member 14, and pivoting top 12, or vice versa.

It is preferable to provide table 10 with retaining means for maintaining table top 12 generally parallel to pedestal members 14 when table 10 is in the folded conformation. One type of such retaining means is shown in FIG. 6 as one or two clip means 100, which are affixed by any convenient means (not shown) to the underside of table top 12 to secure top 12 to cross brace member 16 when table 10 is in the folded conformation. Clip means 100 are located on each side of a line through both pivot means 38 a distance approximately equal to the distance from that line to the top of cross brace member 16. Each clip means 100 comprises a stem 102 extending transverse of the underside of table top 12 and a catch member 104 extending perpendicular to stem 102. The overhanging outer facing edge 106 of catch member 104 is preferably bevelled and, together with stem 102, defines a hook for engaging a corresponding slot in the upper edge of cross brace member 16 when table top 12 is aligned with pedestals 14. Clip means 100 are constructed of a sturdy, yet yieldable material, such as plastic, which will allow edge 106 and stem 102 to deform slightly to accommodate the passage of the upper edge of cross brace member 16 when table top 12 is being folded. Preferably, two clip means 100 are employed, one on each side of the line formed by pivot means 38. The end of catch member 104 opposite edge 106 extends a sufficient distance past stem 102 to function as a handle for unlatching clip means 100 from cross brace member 16 when table 10 is being unfolded.

Figure 7:
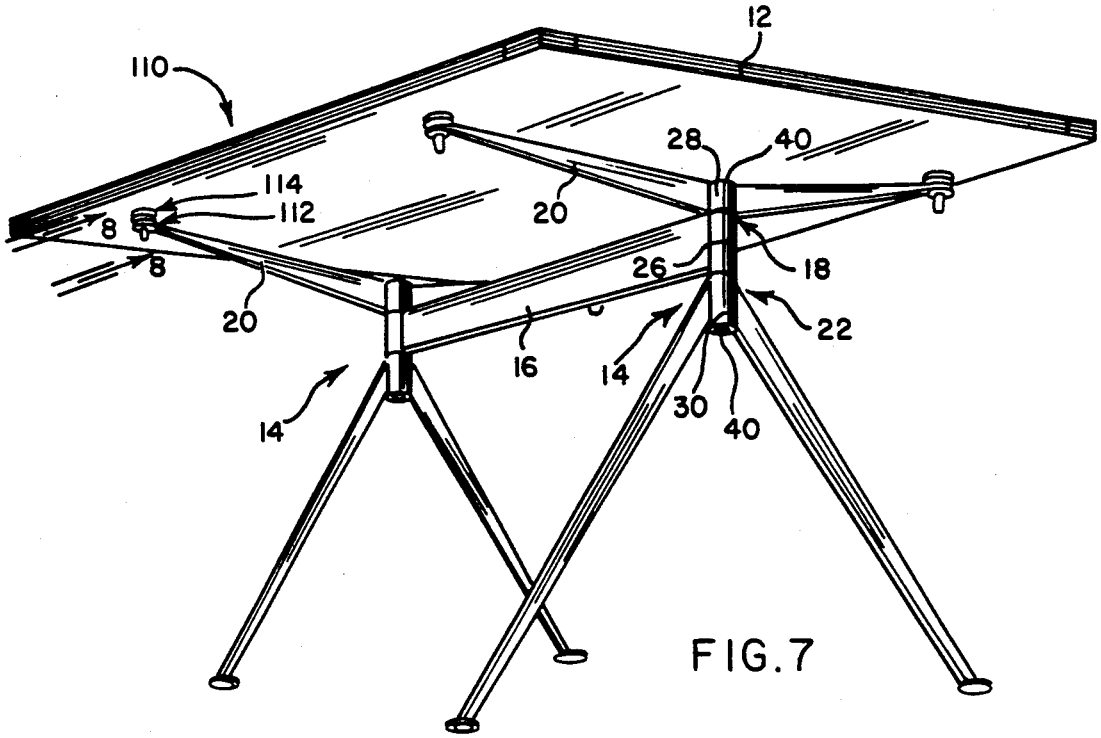
FIG. 7 is a perspective view of another embodiment of the table of present invention showing the table in the unfolded conformation.

Another embodiment of the present invention will be described by reference to FIGS. 7 and 8, wherein the same reference numbers will be used to refer to elements described in the previous embodiment. Referring to FIG. 7, the folding table of this embodiment, indicated generally by reference numeral 110, is similar to table 10 in that it comprises a table top 12, two pedestal members 14, each having an arm section 18 and a leg section 22, and a cross brace member 16. Inner cylindrical member 36 (not visible in FIG. 7) extends axially substantially through arm and leg hubs 28 and 30 and is connected at one end to the bottom of leg hub 30 by securing means 40, as previously described by reference to FIG. 2, and at the other end to the top of arm hub 28 by means similar to securing means 40. Securing means 40 permit arm and leg hubs 28 and 30 to rotate relative to both cylindrical member 36 and tube member 26, but prevent longitudinal movement of arm and leg hubs 28 and 30 and tube member 26 relative to inner cylindrical member 36. Table 110 comprises handle means 112 appended to the end of each arm 20 and coupling means 114 connected to the underside of table top 12 by suitable means (not shown) proximate each handle means 112 when arms 20 are at a substantial angle, for example, ninety degrees, relative to cross brace member 16. In this embodiment, each pedestal member 14 is connected to table top 12 solely through the engagement of handle means 112 with coupling means 114.

Figure 8:
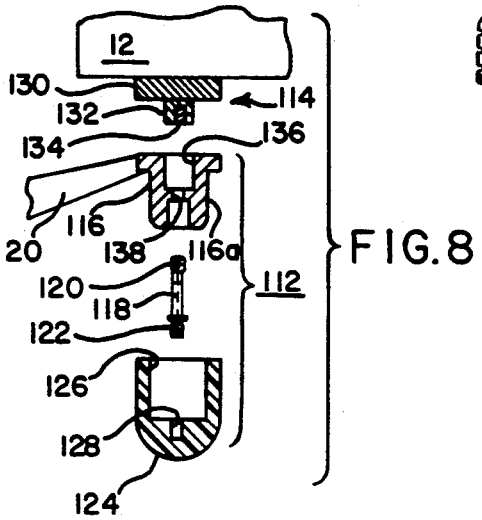
FIG. 8 is an exploded, partial cross-sectional view of a portion of the folding table taken along line 8—8 of FIG. 7.

Referring to FIG. 8, each handle means 112 comprises a handle member 116, which is preferrably formed as part of arm 20 in a single casting operation, a connector 118 having oppositely extending threaded ends 120 and 122, and a handle cover member 124 having an enlarged bore 126 corresponding to the smaller outer diameter portion **116*a* of handle member 116, and a smaller bore 128. Coupling means 114 comprises a base section 130 and a downwardly extending annular nipple 132 having a longitudinal threaded hole 134 extending partially therethrough. Nipple 132 is received within a corresponding bore 136 in the upper surface of handle member 116. An annular constriction 138 communicating with bore 136 permits the upper portion of connector 118 to extend through handle member 116 so that threaded end 120 can be screwed into hole 134 to thereby firmly secure handle means 112 and, therefore, arms 20 to the underside of table top 12. Handle cover member 124 is then secured over handle member 116 by means of a frictional pres fit existing between end 122 and bore 128 when cover member 124 is placed over handle member 116**.

In operation, table 110 is "folded" by disengaging handle means 112 from coupling means 114 by removing handle covers 124 and unscrewing connectors 118, removing table top 12, and then rotating arm and leg sections 18 and 22 into alignment with cross brace member 16. The advantage to table 110 is that table top 12 and the support comprising pedestals 14 and cross brace member 16 can be stored or transported separately. The folding operation can be performed with table 110 in either the upright position, as was described above, or upside down, in which position handle means 112 are disengaged from coupling means 114 and pedestals 14 are disassociated from table top 12.

Figure 9:
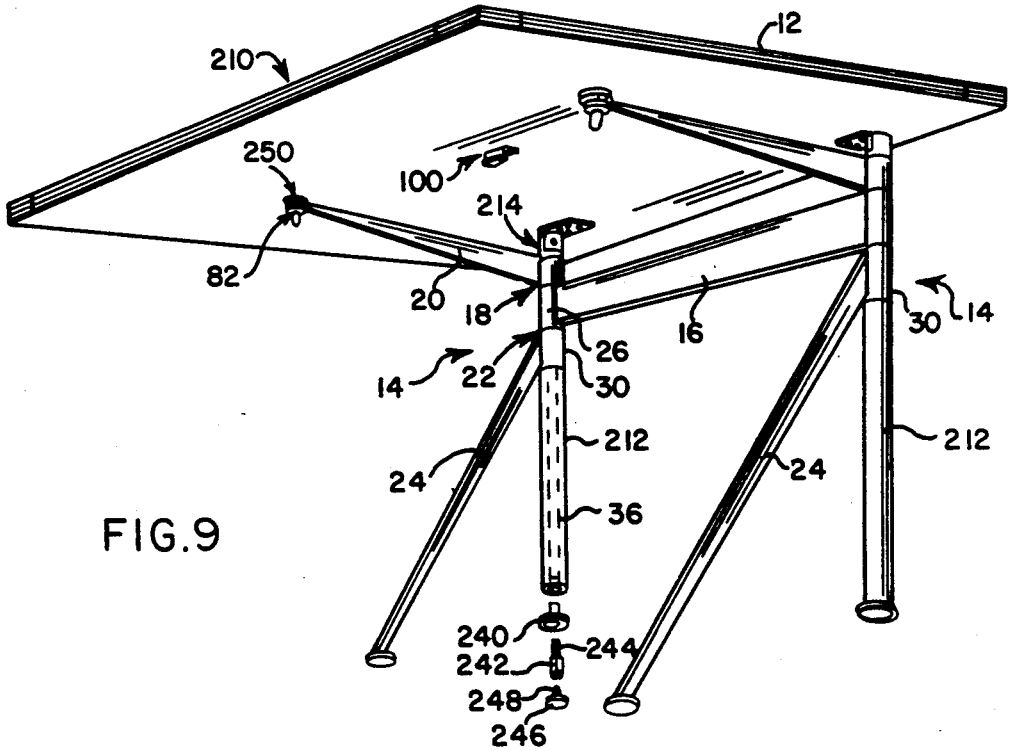
FIG. 9 is a perspective, partial exploded view of another embodiment of the table of the present invention showing the table in the unfolded conformation.
Figure 10:
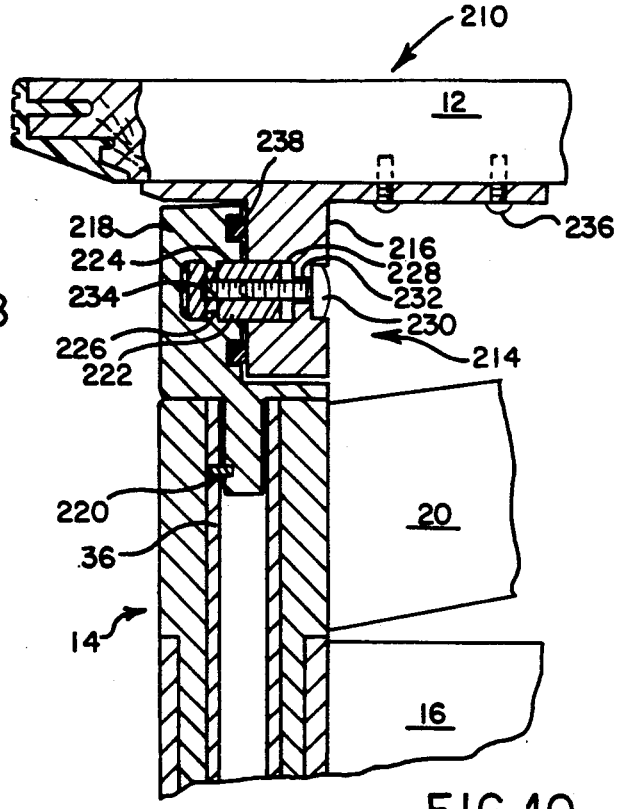
FIG. 10 is a partial cross-sectional view of a portion of the pedestal member and pivot means of the embodiment of the invention shown in FIG. 9.
Figure 11:
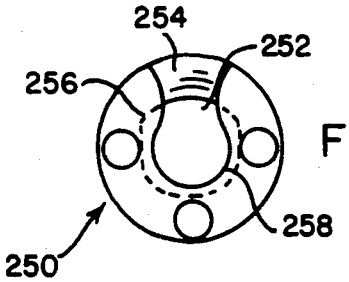
FIG. 11 is a bottom view of the coupling means element of the embodiment of the invention shown in FIG. 9.

A further embodiment of the present invention is described by reference to FIGS. 9, 10 and 11, wherein the same reference numbers will be used to refer to elements described in previous embodiments. Referring to FIG. 9, the folding table of this embodiment, indicated generally by reference numeral 210, comprises a table top 12, two pedestal members 14, and a cross brace member 16. Each pedestal member 14 comprises an arm section 18, an outer cylindrical tube member 26, and a leg section 22. In this embodiment, however, each arm section 18 comprises a single upwardly extending arm 20 and each leg section 22 comprises a single downwardly extending leg 24. Table 210 further comprises a cylindrical column 212 extending vertically below each leg hub 30 which, together with leg 24, maintains table 210 in the upright position when table 210 is in the unfolded conformation.

Each pedestal member 14 of table 210 is pivotably connected to the underside of table top 12 by pivot means, indicated generally by reference number 214. Referring to FIG. 10, each pivot means 214 comprises a pivot bracket 216 connected to the underside of table top 12, a corresponding pivot bracket 218 secured to the top of inner cylindrical member 36 of pedestal member 14 by appropriate means, such as a set pin 220, and a pintle member 222, which is either cast within a transverse bore 224 formed in bracket 218 and held therein by means of an annular constriction 226, or formed as part of bracket 218 in a single casting operation. Pintle 222 extends into a corresponding transverse bore 228 formed in bracket 216 to pivotably connect bracket 218 to bracket 216 and, therefore, pedestal 14 to the underside of table top 12. Each pivot means 214 is preferably held together by means of a screw 230, which extends through a hole 232 communicating with bore 228 and into a corresponding threaded hole 234 in pintle 222. Each pivot means 214 is connected to the underside of table top 12 by screws 236, or any suitable means. Dampening means 238 similar to dampening means 78 may be employed between pivot brackets 216 and 218 to reduce the angular momentum of table top 12 with respect to pedestals 14 when table 210 is being folded or unfolded.

Referring back to FIG. 9, inner cylindrical member 36 extends axially from pivot means 214 through arm and leg hubs 28 and 30 and substantially the length of column 212. The bottom of cylindrical member 36 is non-rotatably secured to column 212 by means of a foot member 240 and a foot member holder 242. Holder 242 is effectively a screw having a threaded shank 244 that passes through an annular opening in foot 240 and engages a corresponding threaded hole in the end of cylindrical member 36 to thereby connect the end of cylindrical member 36 to the bottom of column 212. Table 210 also preferrably comprises a glide 246 having a threaded shank 248 which engages a corresponding threaded hole in the head of holder 242 so that guide 246 can be adjusted up or down with respect to foot 240 to maintain table 210 level even on unlevel surfaces.

Table 210 further comprises coupling means 250 for securing the ends of arms 20 to the underside of table top 12 when table 210 is in the unfolded conformation. Coupling means 250 are suitably connected to the underside of table top 12 proximate handle means 82 on the end of each arm 20 when arms 20 are a substantial angle, for example, ninety degrees, with respect to cross brace member 16. Referring to FIG. 11, each coupling means 250 comprises a base section 252 having a rearward sloping front portion 254, a central generally semi-circular port 256 opening toward sloping portion 254, and a smaller concentric slot 258 communicating with port 256. Port 256 is designed to accommodate head 90 of handle means 82, which has been previously described with reference to FIG. 3, while slot 258 is sized appropriately small enough to receive only the stem 88 of peg 86. Base section 252 is sized to be appropriately thick enough so that, when each arm 20 is rotated to a position a predetermined substantial angle relative to cross brace member 16, the tapered portion of heads 90 will engage sloping portion 254 of base sections 252 to direct head 90 into ports 256 and thereby secure the ends of arms 20 to the underside of table top 12 when folding table 210 is in the unfolded conformation. The folding and unfolding operations of table 210 are performed as described with reference to the embodiment depicted in FIGS. 1, 5 and 6. Additionally, table 210 preferrably comprises clip means 100 to secure top 12 to cross brace member 16 when table 210 is in the folded conformation.

Figure 12:
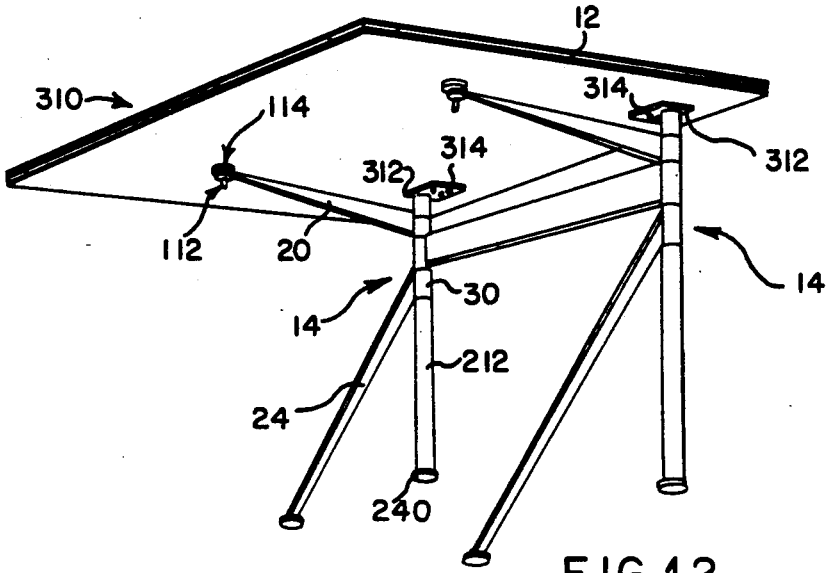
FIG. 12 is a perspective view of another embodiment of the table of the present invention showing the table in the unfolded conformation.

Another embodiment of the present invention is described by reference to FIG. 12, wherein the same reference numbers will be used to refer to elements described in previous embodiments. Referring to FIG. 12, the folding table of this embodiment, indicated generally by reference number 310, is similar to the embodiment depicted in FIG. 9. Table 310, however, comprises an attachment pad 312 in place of each pivot means 214 to fixedly connect each pedestal member 14 to the underside of table top 12. One end of inner cylindrical member 36 of table 310, which is not visible in FIG. 12, is connected to attachment pad 312 by means similar to securing means 40 previously described, while the opposite end is connected to the bottom of column 212 by foot member 240 and foot member holder 242, as was described by reference to FIG. 9. Each attachment pad 312 is connected to the underside of table top 12 by screws 314 or any appropriate means. Table 310 further comprises handle means 112 on the ends of each arm 20 which are connected to the underside of table top 12 by coupling means 114, as was described by reference to FIG. 8. Table 310 is thus folded by removing screws 314, disengaging handle means 112 from coupling means 114, and rotating arms 20 and, consequently, legs 24, to a position substantially parallel to cross brace member 16. The unfolding of table 310 is achieved by reversing the above steps.

It should be understood that, while the present invention has been described in relation to the preferred embodiments thereof, those skilled in the art may develop a wide variation of structural details without departing from the principles of the invention. Therefore, the appended claims are to be construed to cover all equivalents falling within the true scope and spirit of the invention.

What is claimed is:

1. A folding table which comprises:

(a) a table top;

(b) at least two pedestal members;

(c) an elongated cross brace member rotatably connected to both of said pedestal members;

(d) pivot means for pivotably connecting said table top to said pedestal members;

(e) each of said pedestal members comprising an arm section, a leg section, and means for securing the arm section and the leg section together to prevent relative motion therebetween, the arm section including at least one radially extending arm, and the leg section including two legs disposed in fixed relation to each other, at least one leg being radially extending, the pedestal member being rotatable a substantial angle with respect to said cross brace member whereby the arm section supports said table top in a horizontal position and the leg section maintains said folding table in an upright position when said table is in an unfolded conformation.

2. The folding table of claim 1, wherein each of said arm sections comprises two generally divergent, radially extending arms disposed in fixed relation to one another.

3. The folding table of claim 1, wherein each of said leg sections comprises two generally divergent, radially extending legs disposed in fixed relation to each other.

4. The folding table of claim 1, wherein each of said pedestal members further comprises an inner cylindrical member extending axially through said arm section and said leg section.

5. The folding table of claim 4, wherein each of said pedestal members comprises securing means for rotatably connecting said arm section and said leg section to said inner cylindrical member.

6. The folding table of claim 5, wherein each of said pivot means comprises a pintle and means for pivotably connecting an end of said inner cylindrical member to said pintle.

7. The folding table of claim 1, further comprising means for coupling the arm sections to the table top to maintain each of said arm sections in a fixed relationship with respect to the table top and to said cross brace member when said folding table is in the unfolded conformation.

8. The folding table of claim 7, wherein each of said arm sections comprises handle means to facilitate rotation of said arm section with respect to said cross brace member during operation of said table.

9. The folding table of claim 8, wherein said coupling means comprises a port on the table top and each of said handle means comprises an upwardly extending peg having an enlarged head for engaging said port to secure said arm section in fixed relationship with respect to the table top and said cross brace member when said folding table is in the unfolded conformation.

10. The folding table of claim 1, further comprising retaining means for maintaining said table top in a position generally parallel to said pedestal members when said folding table is in a folded conformation.

11. The folding table of claim 10, wherein said retaining means is at least one clip means affixed to the underside of said table top.

12. The folding table of claim 1, wherein each of said pivot means comprises dampening means for reducing the angular momentum of said table top with respect to said pedestal members during transformation of said folding table from a folded to the unfolded conformation or from the unfolded to the folded conformation.

13. A folding table which comprises:

(a) a table top;

(b) at least two pedestal members;

(c) an elongated cross brace member rotatably connected to said pedestal members;

(d) each of said pedestal members comprising an arm section, a leg section, and means for securing the arm section and the leg section together to prevent relative motion therebetween, the arm section including at least one radially extending arm, and the leg section including two legs disposed in fixed relation to each other, at least one leg being radially extending, the pedestal member being rotatable a substantial angle with respect to said cross brace member whereby the arm section supports said table top in a horizontal position and the leg section maintains said folding table in an upright position when said table is in an unfolded conformation.

14. The folding table of claim 13, wherein each of said arm sections comprises two generally divergent, radially extending arms disposed in fixed relation to one another.

15. The folding table of claim 13, wherein each of said leg sections comprises two generally divergent, radially extending legs disposed in fixed relation to one another.

16. The folding table of claim 13, wherein each of said pedestal members further comprises an inner cylindrical member extending axially through said arm section and said leg section.

17. The folding table of claim 16, wherein each of said pedestal members comprises securing means for rotatably connecting said arm section and said leg section to said inner cylindrical member.

18. The folding table of claim 13, further comprising means for coupling the arm sections to the table top to maintain each of said arm sections in a fixed relationship with respect to the table top and to said cross brace member when said folding table is in the unfolded conformation.

19. The folding table of claim 18, wherein each of said arm sections comprises handle means to facilitate rotation of said arm section with respect to said cross brace member.

20. The folding table of claim 19, wherein said coupling means comprises a threaded hole on the table top and each of said handle means comprises a corresponding threaded connector which engages said threaded hole to secure said handle means to said coupling means.

* * * * *

UNITED STATES PATENT AND TRADEMARK OFFICE

CERTIFICATE OF CORRECTION

PATENT NO. : 5,205,223

DATED : April 27, 1993

INVENTOR(S) : DOUGLAS C. BALL, DONALD R. RITTER AND JOHNNY C. FRAGA

It is certified that error appears in the above-identified patent and that said Letters Patent is hereby corrected as shown below:

ON THE TITLE PAGE:

[56] References Cited

U.S. Patent Documents

Delete "2,073,156 2/1937" and substitute therefor -- 2,873,156 2/1959 --.

Column 5, line 38, add a "s" to the word "mean"; and Column 8, line 4, delete "pres" and substitute therefor -- press --.

Signed and Sealed this

Fifteenth Day of March, 1994

Attest:

Bruce Lehman

BRUCE LEHMAN

Attesting Officer

Commissioner of Patents and Trademarks